US009524705B2

(12) United States Patent
Pittel

(10) Patent No.: US 9,524,705 B2
(45) Date of Patent: Dec. 20, 2016

(54) WIND INSTRUMENT SUPPORTS

(71) Applicant: HARVEY PITTEL CREATIONS, INC., Austin, TX (US)

(72) Inventor: Harvey C. Pittel, Austin, TX (US)

(73) Assignee: HARVEY PITTEL CREATIONS, INC., Austin, TX (US)

( * ) Notice: Subject to any disclaimer, the term of this patent is extended or adjusted under 35 U.S.C. 154(b) by 0 days.

(21) Appl. No.: 14/831,299

(22) Filed: Aug. 20, 2015

(65) Prior Publication Data

US 2016/0071502 A1 Mar. 10, 2016

Related U.S. Application Data

(60) Provisional application No. 62/047,451, filed on Sep. 8, 2014.

(51) Int. Cl.
*G10D 9/00* (2006.01)
*G10G 5/00* (2006.01)

(52) U.S. Cl.
CPC ..... *G10G 5/005* (2013.01); *G10D 9/00* (2013.01)

(58) Field of Classification Search
CPC ..... G10G 5/005
See application file for complete search history.

(56) References Cited

U.S. PATENT DOCUMENTS 413,807 A * 10/1889 Loeser et al. ..... G10D 3/18 224/910
2,847,892 A * 8/1958 Laas ..... G10D 9/00 84/380 R
2,933,968 A * 4/1960 Hearne, Jr. ..... G10D 9/00 84/380 R
3,024,690 A * 3/1962 Sanstead ..... G10G 5/00 248/161
3,192,817 A * 7/1965 Schmidt ..... G10G 5/00 84/327
3,266,766 A * 8/1966 Linville, Jr. ..... G10G 5/00 248/122.1
3,811,357 A * 5/1974 Stewart ..... G10G 5/00 84/327
3,955,461 A * 5/1976 Ivie ..... G10G 5/00 84/327

(Continued)

OTHER PUBLICATIONS

2011 Music Show, at http://www.shwoodwind.co.uk/misc/frankfurt2011.htm viewed Mar. 29, 2016 12:15:03 PM.*

(Continued)

*Primary Examiner* — Robert W Horn
(74) *Attorney, Agent, or Firm* — Brian F. Russell; Russell Ng PLLC

(57) ABSTRACT

An instrument support for a wind musical instrument includes a bracket configured to be attached to the wind musical instrument, a base section configured to rest on a trunk of a user, and one or more support members spanning a distance between the bracket and the base section. The instrument support further includes a first adjustment mechanism that can be used to adjustably and selectively fix a position of the one or more support members with respect to the bracket and a second adjustment mechanism that can be used to adjustably and selectively fix the distance between the bracket and the base section.

36 Claims, 4 Drawing Sheets

(56) References Cited

U.S. PATENT DOCUMENTS 3,988,958 A * 11/1976 Brunkow ..... G10D 9/00 84/380 R
4,348,935 A * 9/1982 Bay ..... G10D 9/00 84/380 R
4,596,176 A * 6/1986 Gauger ..... G10D 13/026 84/421
4,841,829 A * 6/1989 Lehmann ..... G10D 9/00 224/267
4,909,125 A * 3/1990 Fece ..... G10D 13/023 84/411 A
D339,601 S * 9/1993 Diefes ..... 84/385 R
5,309,811 A * 5/1994 Hoshino ..... G10D 13/026 248/220.21
5,553,529 A * 9/1996 Smith ..... G10D 9/00 224/910
5,664,758 A * 9/1997 Smith ..... G10D 9/00 248/688
5,789,687 A * 8/1998 Johnson ..... G10G 5/005 84/387 A
5,894,098 A * 4/1999 Hsieh ..... G10D 7/10 84/387 A
D464,985 S * 10/2002 Plovanich ..... D17/13
6,504,087 B2 * 1/2003 Shulman ..... G10G 5/005 84/327
6,759,584 B2 * 7/2004 Sundstrom ..... G10G 5/005 84/387 A
7,307,206 B2 * 12/2007 Payerl ..... F16M 13/02 84/421
7,396,985 B1 * 7/2008 Roth ..... G10D 7/10 84/385 A
7,473,833 B2 * 1/2009 Holtfreter ..... G10D 7/10 84/387 A
7,655,853 B1 * 2/2010 Ricca ..... G10G 5/005 84/385 A
8,431,808 B2 * 4/2013 Nakata ..... G10D 13/026 84/421
8,927,842 B1 * 1/2015 Honjo ..... G10D 13/026 84/411 R
9,038,872 B1 * 5/2015 Chang ..... A45F 5/00 224/257
2005/0145094 A1 * 7/2005 Shumake ..... G10G 5/005 84/453
2007/0056430 A1 * 3/2007 Lee ..... G10G 5/005 84/395
2013/0263718 A1 * 10/2013 Jancic ..... G10D 9/00 84/387 A
2016/0071502 A1 * 3/2016 Pittel ..... G10D 3/18 84/380 R

OTHER PUBLICATIONS

Bass clarinet dilema , posted Apr. 26, 2007, Forum Sax on the Web by Harri Routianen, at http://forum.saxontheweb.net/showthread.php?58204-Bass-clarinet-dilema viewed Mar. 29, 2016 1:02:12 PM.*

Photographs of prototype in use prior to Aug. 20, 2015.

* cited by examiner

WIND INSTRUMENT SUPPORTS

BACKGROUND OF THE INVENTION

The present invention relates to musical instruments, and more specifically, to instrument supports for wind musical instruments.

As is known in the art, several musical instruments traditionally categorized as woodwind instruments utilize similar hand positions. For example, clarinets, saxophones, oboes and English horns all employ the digits of the musician's left hand to cover the upper tone holes or keys closer to the mouthpiece through which the instrument is winded and the digits of the musician's right hand to cover the lower tone holes and keys further from the mouthpiece. The musician's right thumb rests beneath a thumb rest (e.g., a knob, protrusion, or hook) and forms the principal support for the weight of the instrument when played. FIG. 1 illustrates a prior art thumb rest for a clarinet.

Use of the musician's thumb as the primary support for the instrument can, over time, lead to discomfort and strain-induced and over-use injuries, such as carpal tunnel syndrome. The discomfort and injuries are attributable not only to the weight of the instrument itself, but also to the downward displacement of the thumb from its natural resting position in alignment with the index finger, as also shown in FIG. 1. Such maladies are exacerbated by heavier instruments, such as baritone saxophones, which can weigh between 11 and 15 pounds.

To ameliorate the pain and injuries to musicians' right thumbs due to strain and over-use, a variety of straps and harnesses have conventionally been employed in conjunction with the thumb rest to aid in supporting an instrument. For example, it is common for musicians to use a linear loop neck strap or a harness to attempt to transfer some of the weight of the instrument to the neck and shoulders of the musician. The harnesses currently available on the market vary in design, but all seek to further reduce the strain on the neck and upper back caused by the conventional neck straps used in conjunction with thumb rests.

The present invention recognizes that many existing neck straps and harnesses do not provide entirely satisfactory results and, depending on design, can merely temporarily mask the problems experienced by musicians by transferring the strain of bearing the weight of the instrument to the neck and/or shoulders of the musician.

BRIEF SUMMARY

In one embodiment, an instrument support for a wind musical instrument includes a bracket configured to be attached to the wind musical instrument, a base section configured to rest on a trunk of a user, and one or more support members spanning a distance between the bracket and the base section. The instrument support further includes a first adjustment mechanism that can be used to adjustably and selectively fix a position of the one or more support members with respect to the bracket and a second adjustment mechanism that can be used to adjustably and selectively fix the distance between the bracket and the base section. In some embodiments, the instrument support additionally includes a third adjustment mechanism that can be used to adjustably and selectively fix the position of a sling coupling on the one or more support members.

DETAILED DESCRIPTION

Figure 2:
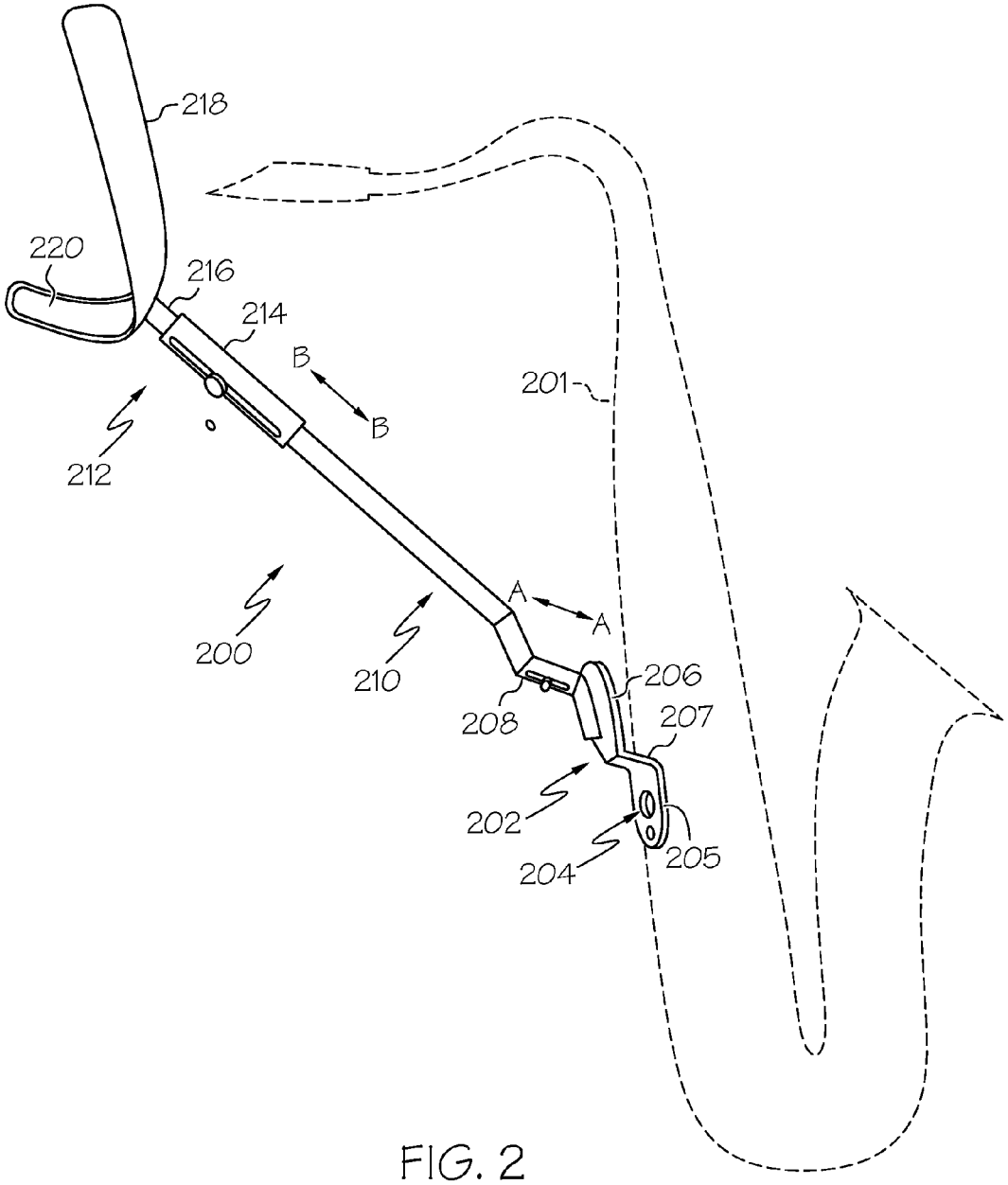
FIG. 2 depicts an instrument support according to a first embodiment of the present invention.

With reference again to the figures and with particular reference to FIG. 2, an instrument support 200 for a wind musical instrument 201 in accordance with a first embodiment of the present invention is illustrated.

Instrument support 200 includes a bracket 202 that is configured to be attached to wind instrument 201, for example, by a fastener (e.g., screw) installed through one or more holes 204 that correspond to one or more recesses in the body of wind instrument 201. For brass woodwind instruments, such as saxophones, it is common for a single screw to be used and for the corresponding recess to be threaded. For wood-bodied woodwind instruments, such as clarinets, oboes and English horns, additional recesses may be employed. In at least some implementations, bracket 202 attaches to wind instrument 201 in place of the conventional thumb rest using the recess(es) provided to attach the conventional thumb rest. As described below, replacement of the conventional thumb rest with instrument support 200 shifts the weight of wind musical instrument 201 from the musician's thumb, reducing the incidence of strain-related discomfort and injury to the musician's thumb, wrist and arm.

In the illustrated embodiment, bracket 202 has a stepped configuration, including a first plate 205 in which through hole 204 is formed and a second plate 206 that is offset from first plate 205 by bridge portion 207. First plate 205 and second plate 206 can be, but are not required to be, disposed in substantially parallel planes.

Projecting from second plate 206 at an acute angle is a first adjustment mechanism 208. In the illustrated embodiment, first adjustment mechanism 208 includes a split sleeve sized to receive therein a proximate end of an elongate support member 210. First adjustment mechanism 208 further includes a screw captured within the slot defined by the split sleeve that enables the musician to adjust how much of the length of the proximate end of elongate support member 210 is received within the split sleeve, thus allowing adjustment of instrument support 200 along a first axis parallel to line A-A. It should be appreciated that first adjustment mechanism 208 can alternatively employ a spring-driven clamp or other alternative adjustment mechanism to provide adjustability along the first axis parallel to line A-A. This adjustment can, for example, be employed by the musician to fine-tune the "tilt" of wind instrument 201 relative to his or her trunk.

Elongate support member 210 can have any of a variety of cross-sectional shapes, such as substantially round, substantially rectangular or irregular. In the depicted embodiment, elongate support member 210 includes a first angled section at its proximal end (obscured in FIG. 2 by first adjustment mechanism 208), a straight section at its distal end, and an angled intermediate section disposed between the first angled section and the straight section. The axes of the straight section and the first angled section are preferably not parallel in order to permit adjustment of instrument support 200 along multiple different axes.

Instrument support 200 further includes a base section 212 having a curved foot 218 configured to rest comfortably on the trunk (e.g., on, below or above the abdomen) of the musician. Comfort of curved foot 218 can be enhanced by the addition of a pad 220, such as foam or rubber, to the concave surface of curved foot 218 that is adapted to rest on the trunk of the musician. Centrally extending from curved foot 218 is a stem 216 that terminates in a second adjustment mechanism 214. In the depicted embodiment, second adjustment mechanism 214 is configured similarly to first adjustment mechanism 208 with a split sleeve sized to receive therein the distal end of elongate support member 210. Second adjustment mechanism 214 further includes a screw captured within the slot defined by the split sleeve that enables the musician to adjust how much of the length of the distal end of elongate support member 210 is received within the split sleeve, thus allowing adjustment of instrument support 200 along a second axis parallel to line B-B (where lines A-A and B-B are neither parallel nor orthogonal). It should be appreciated that second adjustment mechanism 214 can alternatively employ a spring-driven clamp or other alternative adjustment mechanism to provide adjustability along the second axis parallel to line B-B. This adjustment can, for example, be employed by the musician to adjust the distance of wind instrument 201 relative to his or her trunk.

It should be appreciated that in other embodiments, first adjustment mechanism 208 can alternatively be implemented as a separate component of instrument support 200 or as a portion of support member 210. Further, second adjustment mechanism 214 can alternatively be implemented as a separate component of instrument support 200 or as a portion of support member 210.

In various embodiments, instrument support 200 can be formed, for example, of a metal, such as brass, aluminum, magnesium, steel, and/or titanium, and alternatively or additionally, of a plastic. For example, in one embodiment, all of instrument support 200 is formed of one or more metals, except for foot 218, which is formed of a plastic.

Figure 3:
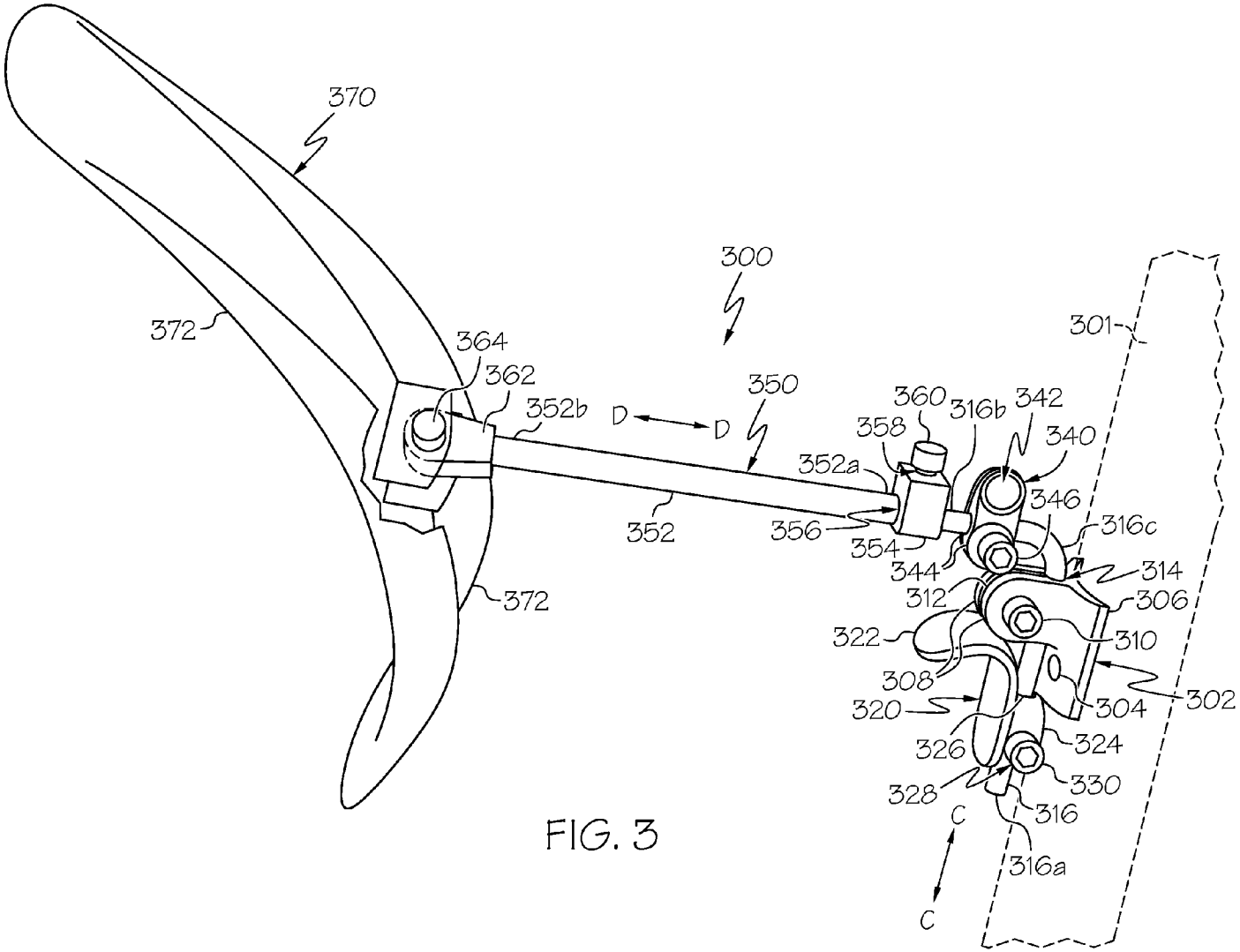
FIG. 3 illustrates an instrument support according to a second embodiment of the present invention.

With reference now to FIG. 3, an instrument support 300 according to a second embodiment of the present invention is illustrated. Instrument support 300 can advantageously be utilized to support a wood-bodied woodwind instrument 301, such as clarinet, oboe, or English horn.

Figure 1:
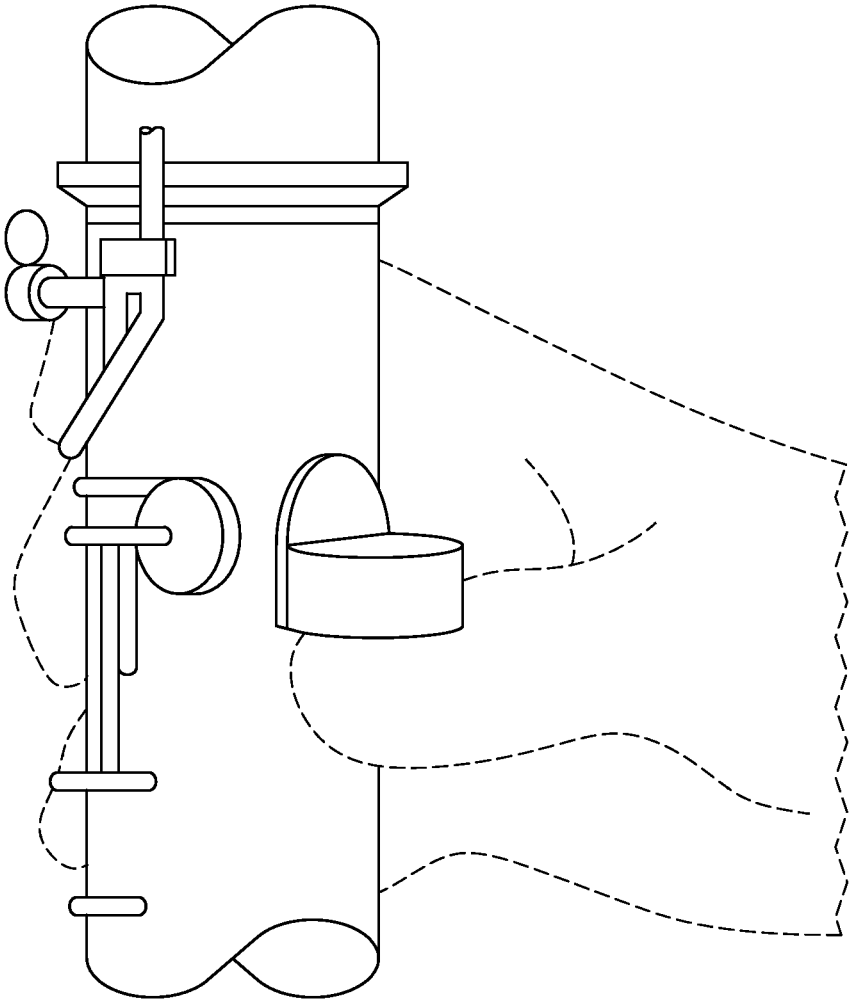
FIG. 1 (PRIOR ART)
FIG. 1 illustrates a prior art thumb rest of a woodwind musical instrument.

Instrument support 300 includes a bracket 302 configured to attach to woodwind instrument 301, a base section 370 configured to rest on the trunk of a user, and one or more support members (e.g., rod 316 and shaft 350) spanning a distance between bracket 302 and base section 370. In the illustrated embodiment, bracket 302 can be attached to woodwind instrument 301 by fasteners (e.g., screw(s)) installed through one or more holes 304 that correspond to one or more recesses in the body of instrument 301. In at least some implementations, bracket 302 attaches to woodwind instrument 301 in place of the conventional thumb rest supplied with woodwind instrument 301 (see, e.g., FIG. 1) using the recess(es) in woodwind instrument 301 provided to attach the conventional thumb rest.

In the illustrated embodiment, bracket 302 includes a curved plate 306 configured to approximate the curve of the body of woodwind instrument 301 and a first adjustment mechanism configured to selectively and adjustably couple bracket 302 to rod 316, where rod 316 includes a proximal end 316*a*, a distal end 316*b* and an elbow 316*c* intermediate proximal end 316*a* and distal end 316*b*. In the illustrated embodiment, the first adjustment mechanism includes a pair of wings 308 integral to bracket 302. In the illustrated embodiment, wings 308 have aligned threaded holes there through in which the threaded shaft of a thumb screw 310 is received. Wings 308 are separated at their outer extremity by a narrow slot 312, and at their inner extremity by a wider bore 314 through which one end (e.g., proximal end 316*a*) of rod 316 is received. By tightening thumb screw 310, wings 308 are forced together, selectively fixing the position of bracket 302 at a desired position along rod 316. It should be appreciated that in various embodiments, thumb screw 310 can further be configured to cooperate with a tool for tightening thumb screw 310, for example, by including a recess for receiving a screwdriver blade or Allen wrench.

Instrument support 300 optionally but preferably further includes a thumb rest 320. Thumb rest 320 includes a hook 322 providing a resting place for a musician's thumb and a body 324 having a bore 326 there through for receiving an end (e.g., proximal end 316*a*) of rod 316. Body 324 includes a threaded hole 328 that is orthogonal to and in communication with bore 326 and in which a thumb screw 330 is received. By tightening thumb screw 330 in threaded hole 328 such that the end of thumb screw 330 engages rod 316, thumb rest 320 may be selectively fixed at a desired position along rod 316.

It should further be noted that in order to achieve a desired configuration of instrument support 300, various components of instrument support 300 can be selectively configured in a manner different than that illustrated in FIG. 3. For example, bracket 302 can be installed on rod 316 in an inverted position relative to that shown in FIG. 3 (i.e., with wings 308 toward proximal end 316*a* of rod 316). As another example, the mounting locations of bracket 302 and thumb rest 320 on rod 316 can be exchanged, with bracket 302 closer to proximal end 316*a* of rod 316. As yet another example, the position of rod 316 may be reversed, such that bracket 302 and, if present, thumb rest 320 are mounted on rod 316 intermediate distal end 316*b* of rod 316 rod and elbow 316*c*. Because the length between distal end 316*b* and elbow 316*c* is greater than the length between proximal end 316*a* and elbow 316*c* (e.g., the length between distal end 316*b* and elbow 316*c* may be approximately 3 inches, while the length between proximal end 316*a* and elbow 316*c* is approximately 2 inches), reversing the position of rod 316 adjusts a distance between the trunk of the musician and instrument 301. It should further be noted that although FIG. 3 illustrates an embodiment in which elbow 316*c* has a 90 degree bend, in other embodiments, elbow 316*c* may define a larger or smaller angle and/or may be adjustable, for example, by using a multi-position locking hinge.

Instrument support 300 optionally but preferably further includes a sling coupling 340. As indicated, sling coupling 340, if present, may be mounted on rod 316 on the opposite leg of rod 316 from bracket 302. At a first end, sling coupling 340 includes an eye 342 through which the hook of a conventional neck sling may be coupled. At a second end, sling coupling 340 further includes a pair of wings 344 integral to sling coupling 340. As with the previously described wings 308 of bracket 302, wings 344 have aligned threaded holes there through in which the threaded shaft of a thumb screw 346 is received. Wings 308 are separated at their outer extremity by a narrow slot, and at their inner extremity by a wider bore through which one end (e.g., distal end 316*b*) of rod 316 is received. By tightening thumb screw 346, wings 344 are forced together, selectively fixing the position of sling coupling 340 at a desired position along rod 316. As described above, thumb screw 346 can further be configured to cooperate with a tool for tightening thumb screw 346, for example, by including a recess for receiving a screwdriver blade or Allen wrench.

Instrument support 300 further includes a shaft 350, which includes central tube 352, a second adjustment mechanism configured to couple shaft 350 to rod 316, and a third attachment mechanism configured to couple shaft 350 to a base section 370. In the illustrated embodiment, tube 352 has a hollow central bore sized to receive an adjustably selectable length of rod 316 therein. In one embodiment, tube 352 may have a length of approximately 3.5 inches. In the depicted embodiment, the second adjustment mechanism includes a clamp 354 having a bore 356 there through sized to snugly receive (e.g., with an interference fit) a proximal end 352*a* of tube 352 therein. Clamp 354 further includes a threaded hole 358 that is orthogonal to and in communication with bore 356 and in which a thumb screw 360 is received. By tightening thumb screw 360 such that an end of thumb screw engages tube 352, the length of rod 316 received within tube 352 can be selectively adjusted and fixed. In the illustrated embodiment, the third attachment mechanism comprises a pivot coupling 362. Pivot coupling 362 includes a recess in which a distal end 352*b* of tube 352 is snugly received (e.g., with interference fit). Pivot coupling 362 further includes an eye by which a pivot fastener 364 (e.g., a brad, a rivet, a bolt and nut, etc.) can be used to pivotally couple shaft 350 to base section 370.

In the illustrated embodiment, base section 370 includes a pair of wings spaced to receive pivot coupling 362 there between and holes to pivotally receive the pivot fastener 364 there through. Base section 370 further includes a curved foot 372 configured to rest comfortably on the trunk of the musician. As above, comfort of curved foot 372 can optionally be enhanced by the addition of a pad, such as foam or rubber, to the concave surface of curved foot 372 adapted to rest on the trunk of the musician. In one exemplary embodiment, curved foot 372 has a length of approximately 12 inches, a width of approximately 1 inch and a radius of curvature of approximately 13 inches.

Instrument support 300 can be formed, for example, of a metal, such as brass, aluminum, magnesium, steel, or titanium, and alternatively or additionally, of a plastic. For example, in one embodiment, all of instrument support 300 is formed of one or more metals, except for base section 370, which is formed of a plastic. It should also be appreciated that shaft 350 and rod 316 can have any of a variety of cross-sectional shapes, such as substantially round, substantially rectangular or irregular.

In use, bracket 302 of instrument support 300 is attached to woodwind instrument 301, preferably in place of the conventional thumb rest provided with woodwind instrument 301. The musician can also adjust the first adjustment mechanism to configure instrument support 300 along a first axis parallel to line C-C and adjust the second adjustment mechanism to configure instrument support 300 along a second axis parallel to line D-D, which in a preferred embodiment can be substantially orthogonal (i.e., within plus or minus 5 degrees of orthogonal) to line C-C. Thus, the first adjustment mechanism can be used to adjust and set the vertical "drop" of woodwind instrument 301 with respect to the musician's trunk, and the second adjustment mechanism can be used to adjust and set the distance between the bracket 302 and the base section 370.

Figure 4:
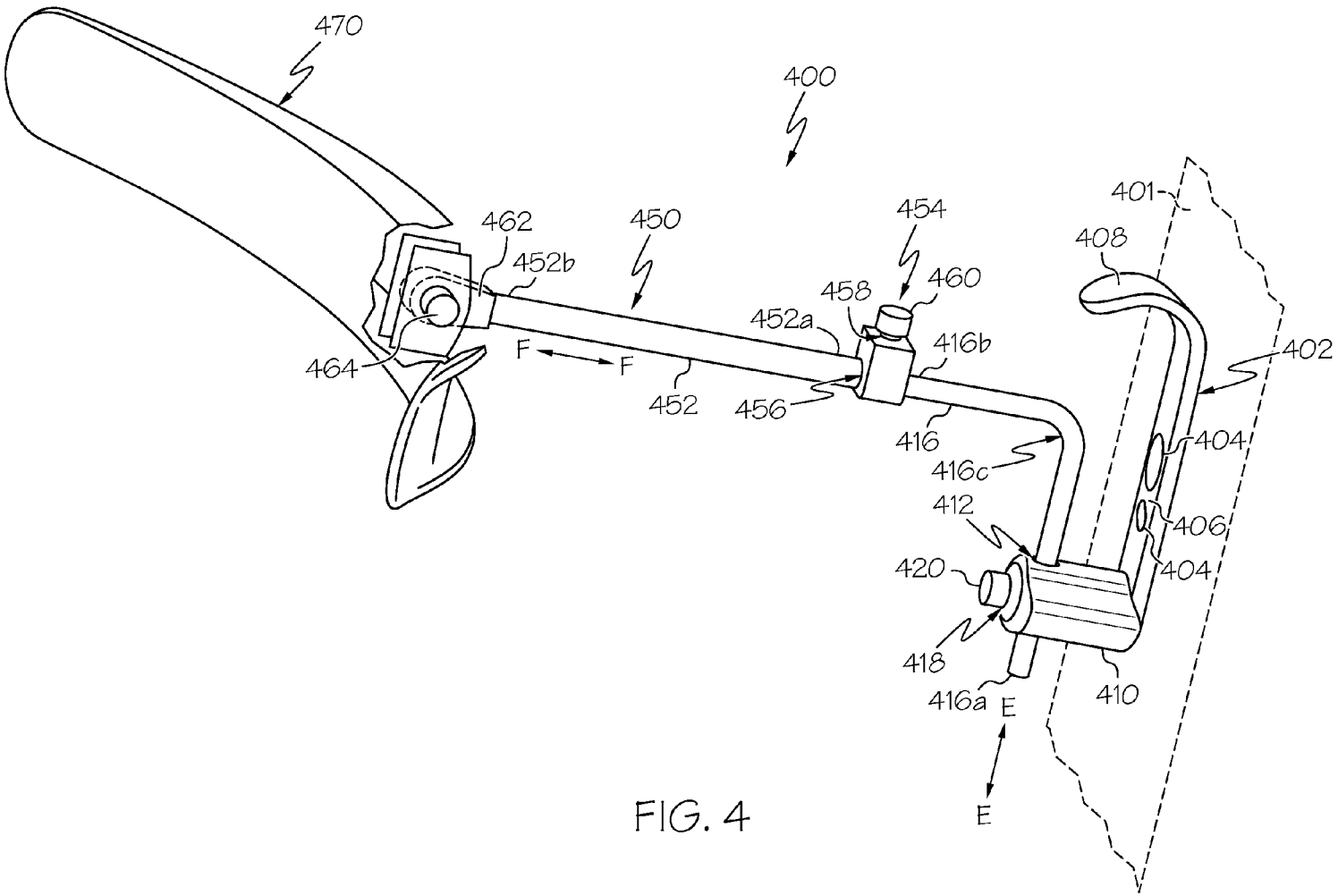
FIG. 4 depicts an instrument support according to a third embodiment of the present invention.

Referring now to FIG. 4, an instrument support 400 according to a third embodiment of the present invention is illustrated. Instrument support 400 can advantageously be utilized to support a brass woodwind instrument 301, such as a soprano, tenor, alto or baritone saxophone.

Instrument support 400 includes a bracket 402 configured to attach to woodwind instrument 401, a base section 470 configured to rest on the trunk of a user, and one or more support members (e.g., rod 416 and shaft 450) spanning a distance between the bracket and the base section. In the illustrated embodiment, bracket 402 can be attached to woodwind instrument 401 by one or more fasteners (e.g., screw(s)) installed through one or more holes 404 that correspond to one or more recesses in the body of instrument 401. In at least some implementations, bracket 402 attaches to the instrument in place of the conventional thumb rest supplied with woodwind instrument 401 using the threaded recess(es) in woodwind instrument 401 provided to attach the conventional thumb rest.

In the illustrated embodiment, bracket 402 includes a plate 406 terminating at one end in a hook 408 under which a musician may rest his thumb and further including a first adjustment mechanism configured to couple bracket 402 to a rod 416, where rod 416 includes a proximal end 416*a*, a distal end 416*b* and an elbow 416*c* intermediate proximal end 416*a* and distal end 416*b*. In the illustrated embodiment, the adjustment mechanism includes a boss 410 having a bore 412 there through for receiving one end (e.g., proximal end 416*a*) of rod 416. In a preferred embodiment, bore 412 is generally aligned with the long axis of the body of instrument 401. Boss 410 further includes a threaded hole 418 that is orthogonal to and in communication with bore 412 and in which a thumb screw 420 is received. By tightening thumb screw 420 in threaded hole 418 such that the end of thumb screw 420 engages rod 416, rod 416 may be selectively and adjustably fixed at a desired position relative to bracket 402. It should be appreciated that in various embodiments, thumb screw 420 can further be configured to cooperate with a tool for tightening thumb screw 420, for example, by including a recess for receiving a screwdriver blade or Allen wrench.

It should further be noted that in order to achieve a desired configuration of instrument support 400, various components of instrument support 400 can be selectively configured in a manner different than that illustrated in FIG. 4. For example, the position of rod 416 may be reversed, such that bracket 402 is coupled to the leg of rod 416 extending between elbow 416*c* and distal end 416*b*. Alternatively or additionally, an end 416*a*, 416*b* of rod 416 may be inserted into the bore 412 of boss 410 through its lower (unillustrated) opening rather than its upper opening as shown in FIG. 4. It should further be noted that although FIG. 4 illustrates an embodiment in which elbow 416*c* has a 90 degree bend, in other embodiments, elbow 416*c* may define a larger or smaller angle and/or may be adjustable, for example, by using a multi-position locking hinge. In addition, instrument support 400 may optionally further include a sling coupling (much like sling coupling 340 of FIG. 3), which in some embodiments may be mounted on rod 416.

Instrument support 400 further includes a shaft 450, which includes central tube 452, a second adjustment mechanism configured to couple shaft 450 to rod 416, and a third attachment mechanism configured to couple shaft 450 to a base section 470. In the illustrated embodiment, tube 452 has a hollow central bore sized to receive an adjustably selectable length of rod 416 therein. In the depicted embodiment, the second adjustment mechanism includes a clamp 454 having a bore 456 there through sized to snugly receive (e.g., with an interference fit) a proximal end 452*a* of tube 452 therein. Clamp 454 further includes a threaded hole 458 that is orthogonal to and in communication with bore 456 and in which a thumb screw 460 is received. By tightening thumb screw 460 such that an end of thumb screw engages tube 452, the length of rod 416 received within tube 452 can be selectively adjusted and fixed. In the illustrated embodiment, the third attachment mechanism comprises a pivot coupling 462. Pivot coupling 462 includes a recess in which a distal end 452*b* of tube 452 is snugly received (e.g., with interference fit). Pivot coupling 462 further includes an eye by which a pivot fastener 464 (e.g., a brad, a rivet, a bolt and nut, etc.) can be used to pivotally couple shaft 450 to base section 470.

In the illustrated embodiment, base section 470 includes a pair of wings spaced to receive pivot coupling 462 there between and holes to pivotally receive the pivot fastener 464 there through. Base section 470 further includes a curved foot 472 configured to rest comfortably on the trunk of the musician. As above, comfort of curved foot 472 can optionally be enhanced by the addition of a pad, such as foam or rubber, to the concave surface of curved foot 472 adapted to rest on the trunk of the musician.

As with the second embodiment described above, instrument support 400 can be formed, for example, of a metal, such as brass, aluminum, magnesium, steel, or titanium, and alternatively or additionally, of a plastic. For example, in one embodiment, all of instrument support 400 is formed of one or more metals, except for base section 470, which is formed of a plastic. It should also be appreciated that shaft 450 and rod 416 can have any of a variety of cross-sectional shapes, such as substantially round, substantially rectangular or irregular.

In use, bracket 402 of instrument support 400 is attached to woodwind instrument 401, preferably in place of the conventional thumb rest provided with woodwind instrument 401. The musician can also adjust the first adjustment mechanism to configure instrument support 400 along a first axis parallel to line E-E and adjust the second adjustment mechanism to configure instrument support 400 along a second axis parallel to line F-F, which in a preferred embodiment can be substantially orthogonal (i.e., within plus or minus 5 degrees of orthogonal) to line E-E. Thus, the first adjustment mechanism can be used to adjust and set the vertical "drop" of woodwind instrument 401 with respect to the musician's trunk, and the second adjustment mechanism can be used to adjust and set the distance between the bracket 402 and the base section 470.

As has been described, in some embodiments, an instrument support for a musical instrument includes a bracket configured to be attached to the musical instrument, a base section configured to rest on the trunk of a user, and one or more support members spanning a distance between the bracket and the base section. The instrument support further includes a first adjustment mechanism that can be used to adjustably and selectively fix a position of the one or more support members with respect to the bracket and a second adjustment mechanism that can be used to adjustably and selectively fix the distance between the bracket and the base section. By using the trunk of the user as the principal support for the weight of the instrument, discomfort, strain and injury to the thumb, hand and arm of the musician can be reduced.

In at least one embodiment, the one or more support members include a first member (e.g., shaft 350, 450) and a second member (e.g., rod 316, 416) that telescopes within the first member.

In at least one embodiment, the first and second adjustment mechanisms allow instrument support to be configured along two axes. In some embodiments, the axes are substantially orthogonal. In other embodiments, the axes are neither parallel nor orthogonal.

The disclosed instrument supports are applicable to woodwind musical instruments, such as clarinets, saxophones, oboes and English horns, but is not restricted to use with these musical instruments. For example, the disclosed instrument supports can be adapted for use with wind instruments, such as trumpets, trombones, flutes, and French horns. In at least some embodiments, the bracket for such musical instruments can be implemented utilizing a clamp or other member that attaches to or surrounds a tube or body of the wind instrument.

While the present invention has been particularly shown as described with reference to one or more preferred embodiments, it will be understood by those skilled in the art that various changes in form and detail may be made therein without departing from the spirit and scope of the invention. For example, although specific embodiments of adjustment mechanisms employing screws have been described, in other embodiments one or more of the adjustment mechanisms may alternatively employ spring-biased pins that cooperate with detents in a support member, clamping collars, or other adjustment mechanism as known in the art. In addition, although in the described embodiments the bracket is removably attached to the instrument in place of the conventional thumb rest utilizing one or more screws, in other embodiments the bracket can instead be removably attached to the instrument utilizing an adhesive tape. The bracket can be attached to the body of the instrument in place of the conventional thumb rest or can be attached to the body instrument at an alternative location (meaning that, if desired, the conventional thumb rest can be retained in place). Moreover, it should be appreciated that the components of the various embodiments may be combined with and/or substituted for the components of other embodiments. Further, it should be understood that the term "coupled" is defined herein to include both direct attachment, contact or connection and indirect attachment, contact or connection through one or more intermediate members.

What is claimed is:

1. A wind instrument support for a wind musical instrument, the wind instrument support comprising:

a bracket configured to be attached to the wind musical instrument;

a base section configured to rest on a trunk of a user;

multiple elongate support members spanning a distance between the bracket and the base section, wherein the multiple elongate support members include:

a first support member that has at least one bend and that is configured to be coupled to the bracket; and a second support member that is configured to be attached to the base section and angled away from the trunk of the user, wherein one of the first and second support members is adjustably and telescopically received into the other of the first and second support members;

a first adjustment mechanism that adjustably and selectively fixes a position of the first support member with respect to the bracket; and a second adjustment mechanism that adjustably and selectively fixes a portion of the one of the first and second support members telescopically received within the other of the first and second support members and thus the distance between the bracket and the base section.

2. The wind instrument support of claim 1, wherein:

the first adjustment mechanism adjusts the wind instrument support along a first axis;

the second adjustment mechanism adjusts the wind instrument support along a second axis; and the first and second axes are neither parallel nor orthogonal.

3. The wind instrument support of claim 1, wherein:
the first adjustment mechanism adjusts the wind instrument support along a first axis;
the second adjustment mechanism adjusts the wind instrument support along a second axis; and
the first and second axes are substantially orthogonal.

4. The wind instrument support of claim 1, and further comprising:
a thumb rest coupled to the first support member.

5. The wind instrument support of claim 4, wherein the thumb rest is integral to the bracket.

6. The wind instrument support of claim 1, wherein the second support member is pivotally coupled to the base section.

7. The wind instrument support of claim 1, and further comprising a sling coupling coupled to one of the multiple support members.

8. The wind instrument support of claim 1, wherein the first adjustment mechanism is at least partially integral to the bracket.

9. The wind instrument support of claim 8, wherein:
the bracket has a bore through a portion thereof that receives therein one the first support member.

10. The wind instrument support of claim 1, wherein:
the second adjustment mechanism comprises a clamp; and
the first support member telescopes within the second support member.

11. The wind instrument support of claim 1, wherein the bracket has one or more holes each configured to receive therein a fastener for attaching the bracket to the instrument.

12. The wind instrument support of claim 1, wherein the bracket and the one or more support members are formed of metal.

13. The wind instrument support of claim 1, wherein the base section includes a curved foot.

14. An apparatus, comprising:
the wind instrument support of claim 1; and
a wind instrument coupled to the bracket.

15. The wind instrument support of claim 1, wherein the first support member is telescopically received within the second support member.

16. The wind instrument support of claim 1, wherein:
the at least one bend comprises an elbow;
the first support member includes a proximal end and a distal end; and
a first distance between the distal end and the elbow is greater than a second distance between |the proximal end and the elbow.

17. The wind instrument support of claim 16, wherein the first distance is approximately 3 inches and second distance is approximately 2 inches.

18. The wind instrument support of claim 16, wherein an angle of the elbow is adjustable.

19. The wind instrument support of claim 16, wherein the bracket is coupled to the first support member closer to the proximal end.

20. The wind instrument support of claim 16, wherein the bracket is coupled to the first support member closer to the distal end.

21. The wind instrument support of claim 1, wherein:
the first support member and the bracket are configured such that the first support can be attached to the bracket in a first configuration and in an alternative second configuration in which the first support member has an inverted position relative to the first configuration.

22. The wind instrument support of claim 1, wherein the second support member includes a straight shaft.

23. The wind instrument support of claim 22, wherein the straight shaft has a length of approximately 3.5 inches.

24. A wind instrument support for a wind musical instrument, the wind instrument support comprising:
a bracket configured to be attached to the wind musical instrument;
a base section configured to rest on a trunk of a user;
first and second support members extending between the bracket and the base section, wherein the second support member is attached to the base section and the first support member is attached to the bracket, wherein the first support member includes at least one bend and telescopes within the second support member;
a first adjustment mechanism that adjustably and selectively fixes a position of the first support member with respect to the bracket; and
a second adjustment mechanism that adjustably and selectively fixes a length of the first support member received within the second support member.

25. The wind instrument support of claim 24, wherein:
the first adjustment mechanism adjusts the wind instrument support along a first axis;
the second adjustment mechanism adjusts the wind instrument support along a second axis; and
the first and second axes are substantially orthogonal.

26. The wind instrument support of claim 24, and further comprising:
a thumb rest coupled to the first support member.

27. The wind instrument support of claim 26, wherein the thumb rest is integral to the bracket.

28. The wind instrument support of claim 24, wherein the second support member is pivotally attached to the base section.

29. The wind instrument support of claim 24, and further comprising a sling coupling coupled to one of the first and second support members.

30. The wind instrument support of claim 24, wherein the first adjustment mechanism is at least partially integral to the bracket.

31. The wind instrument support of claim 30, wherein:
the bracket has a bore through a portion thereof that receives therein the first support member.

32. The wind instrument support of claim 24, wherein the second adjustment mechanism comprises a clamp.

33. The wind instrument support of claim 24, wherein the base section includes a curved foot.

34. A method of supporting a wind musical instrument utilizing a wind instrument support, comprising:
attaching a wind instrument support to the wind musical instrument, wherein the wind instrument support includes:
a bracket configured to be attached to the wind musical instrument;
a base section configured to rest on a trunk of a user;
multiple elongate support members spanning a distance between the bracket and the base section, wherein the multiple elongate support members include:
a first support member that has at least one bend and that is configured to be coupled to the bracket; and
a second support member that is configured to be attached to the base section and angled away from the trunk of the user, wherein one of the first and second support members is adjustably and telescopically received into the other of the first and second support members;

a first adjustment mechanism that adjustably and selectively fixes a position of the first support member with respect to the bracket; and a second adjustment mechanism that adjustably and selectively fixes a portion of the one of the first and second support members telescopically received within the other of the first and second support members and thus the distance between the bracket and the base section; and adjusting one or more of the first and second adjustment mechanisms.

35. The method of claim 34, wherein the attaching includes attaching the bracket in place of a thumb rest of the wind musical instrument.

36. The method of claim 34, and further comprising resting the base section on the trunk of the user.

* * * * *